US006491299B1

(12) United States Patent
Gordon

(10) Patent No.: US 6,491,299 B1
(45) Date of Patent: Dec. 10, 2002

(54) BRIDGE BIDDING DEVICE

(76) Inventor: James Gordon, 350 Sorrento Ranches Dr., Nokomis, FL (US) 34275

( * ) Notice: Subject to any disclaimer, the term of this patent is extended or adjusted under 35 U.S.C. 154(b) by 0 days.

(21) Appl. No.: 09/905,923

(22) Filed: Jul. 17, 2001

(51) Int. Cl.[7] ..... A63B 71/00

(52) U.S. Cl. ..... 273/148 R; 273/148 A; 273/150

(58) Field of Search ..... 273/148 R, 148 A, 273/292, 150

(56) References Cited

U.S. PATENT DOCUMENTS

| | | | | | |
|---|---|---|---|---|---|
| 1,344,547 | A | * | 6/1920 | Maier | 273/150 |
| 1,460,791 | A | * | 7/1923 | Cunningham | 273/150 |
| 1,479,350 | A | * | 1/1924 | Wiel | 273/150 |
| 1,893,594 | A | * | 1/1933 | Oestreich | 273/150 |
| 3,628,259 | A | * | 12/1971 | Kahn | 273/148 R |
| 4,030,764 | A | * | 6/1977 | Mattos | 273/148 R |
| 4,074,442 | A | * | 2/1978 | Landry | 273/148 R |
| 4,173,342 | A | * | 11/1979 | De Corlieu-Ferran | 273/148 R |
| 4,175,336 | A | * | 11/1979 | Heck | 273/148 R |
| 4,190,253 | A | * | 2/1980 | Andrae | 273/148 R |
| 4,248,434 | A | * | 2/1981 | Weigl | 273/148 R |
| 4,671,515 | A | * | 6/1987 | Burgess | 273/150 |
| 4,684,132 | A | * | 8/1987 | Wolford | 273/150 |
| 4,927,146 | A | * | 5/1990 | Bull | 273/150 |
| 4,927,149 | A | * | 5/1990 | Bull | 273/150 |
| 5,014,996 | A | * | 5/1991 | von Braunhut | 273/150 |
| 5,029,797 | A | * | 7/1991 | Levorchick et al. | 248/459 |
| 5,094,455 | A | * | 3/1992 | Persuy | 273/148 A |
| 5,200,890 | A | * | 4/1993 | Pionchon | 273/148 R |
| 5,383,666 | A | * | 1/1995 | Kaplan | 273/148 R |
| 5,482,275 | A | * | 1/1996 | Grinoch et al. | 273/142 HA |
| 5,743,797 | A | * | 4/1998 | Jannersten | 463/11 |
| 5,829,958 | A | * | 11/1998 | Ozarow | 273/148 R |
| 6,116,598 | A | * | 9/2000 | Maythenyi | 273/148 A |

FOREIGN PATENT DOCUMENTS

| | | | | |
|---|---|---|---|---|
| FR | 2676933 | * | 12/1992 | A63F/1/10 |

* cited by examiner

*Primary Examiner*—Benjamin H. Layno
*Assistant Examiner*—Dolores R. Collins
(74) *Attorney, Agent, or Firm*—Browdy and Neimark, P.L.L.C.

(57) ABSTRACT

A bridge bidding box is provided comprising two parts: a bottom and a top part. When the box is opened, the bottom part is removed and placed into a cut out area of the top part. The cut out area of the top part is angled so that when the bottom part is placed into this cut out area, the cards in the bottom part are automatically angled backwards, making it easier to see and remove the bid cards from the box. This configuration allows the entire box to lie flat on the table, providing stability and proper weight distribution. The bottom of the box is provided with non-skid gripping material, which prevents the box from moving or sliding on the table. When the base part is placed into the top part, the top part is at an angle and weight distribution that it is difficult to tip over the box.

9 Claims, 4 Drawing Sheets

BRIDGE BIDDING DEVICE

FIELD OF THE INVENTION

The present invention relates to devices used for bidding in the game of bridge.

BACKGROUND OF THE INVENTION

Bridge is a partnership game with two players to each partnership. Players are given the names North, South, East and West, corresponding to points on the compass. That is, North sits opposite South, and East sits opposite West. North and South are a partnership, and East and West are a partnership. Before each hand is played, an auction is conducted to decide which suit of the four, hearts, spades, clubs, or diamonds, will be the trump suit, the cards in the trump suit having more power to win tricks than the cards in any other suit. At this time it is decided which partnership will be the defense, and which partnership will contract to win a certain number of tricks. A trick includes the play of one card from each player's hand, and the player who plays the most powerful card wins the trick.

In the duplicate form of contract bridge, bidding boxes and convention cards are used to conduct a silent auction in order to avoid any vocal inflections that, in a verbal auction, might give one's partner unauthorized information about the contents of one's hand. Each hand includes 13 of the 52 cards that have been dealt from the 52 cards in the deck. Each of four players thus holds 25% of the cards in the deck. In duplicate bridge, the cards patterns, or hands, are dealt and put into a holder called a board. The board keeps each of the four hands from getting mixed up. After a certain number of hands are dealt and played, the boards, as well as the East-West pairs, move from table to table, so that the players, as well as the hands in each board, are played by different partnerships throughout the bridge session. The results, or scores, are compared at the end of the playing period, and whichever pairs has the best results, when the scores from all boards are compared, win the bridge session.

Tournament play requires the use of bidding boxes so that each player makes a bid silently by removing the appropriate bid player card from the bidding box and displaying it in an accepted manner, even if the bid made is inappropriate or in violation of existing contract bridge bidding rules.

Currently available bidding boxes are all designed to facilitate silent bidding. These devices were meant either to sit on top of the playing table or to be mounted on the side of the table.

The first previously known bidding device is the Bid Box from Germany. This is a cone piece design made of a flexible composite. The underside or bottom of the device has a lid that snaps in place, which is where the cards are stored when not in use. The cards can be removed and placed into a slotted area on the top rear of the box. The cards rest on the inside of the bottom lid so that they are maintained in an upright position. Unfortunately, the design of this box permits it to slide easily on the table, so that it can easily be knocked off, causing the cards to fly out of the box. When the box is mounted on the side of a card table, the lid must be closed properly to prevent the cards from falling out. Also, the cards may fall through the bottom if too much pressure is put on the lid when replacing the cards after bidding. The open area on top allows dirt and debris to enter the box and allows the cards to soil easily. Storing and stacking the boxes is cumbersome because of the design of the boxes. These boxes are generally made from soft plastic.

Another one-piece design is the Neo-classic from Sweden. This box works exactly like the Bid Box, but the top of the box has been rearranged so that the two slotted areas are evenly centered over the base. This modified shape make it easier to stack boxes on top of each other, but the boxes require a lot of space because of their size. The two open slots are sized differently. The front, smaller, slot holds the pass, double, re-double, alert, and stop cards. The other, larger, slot contains the bid cards. For the cards to remain upright, they must rest on the inside bottom lid. This box slides off the table easily, is big and bulky, and takes up a lot of table space. When the box is attached to the table, the cards can fall out of the bottom in the same way as with the Bid Box. The open area on top allows dirt and debris to enter the box, and allows the cards to soil easily. This box is made of a semi hard composite and is relatively durable.

The Universal Bidding Box appears to be the only two piece bidding box currently available. This box also originates in Sweden. The composite of which the box is made is thick, hard plastic, and is sturdy in design. This box takes up the smallest space on the table, and its seat design is quite unique. Cards are easy to grab, but the box, when placed on the table, is the least stable of all known biding boxes, and it can be knocked off the table quite easily. When the box is knocked over, the cards fly out onto the floor, although the box works well when bracketed to the table. This box is difficult for many people to open and close, and thus it requires directions on the top and bottom. This box is the most cumbersome for storage, principally because of its shape. The boxes do not stack at all. The boxes can be linked or snapped together, but this is impractical, so that storage is a problem. The open area in the middle of the box permits dirt and debris to enter the box and soil the card, although not to the extent as the Neo or the Bid Box.

The Pocket Style bidding box is a one-piece bidding box which is easy to use. However, it takes up too much room on the table to be useful, and it is difficult to close the unit. The cards must be repositioned when the box is opened to play and when the box is closed. The cards are difficult to reposition and are often misplaced in this box. This causes bending of some of the cards. However, the cards are totally enclosed, so that dirt and debris are prevented from entering the box and soiling the cards. Because it takes up too much room on the table, this is the least used box. However, it is easily stackable and thus uses less storage space than some of the other boxes. This box uses a composite that is both flexible, non-flexible, and thin material. The material of the which the box is made is not sturdy.

The Bridge Partner from Sweden is easy to use; the flip box is easy to open and close. When the box is flipped open, the cards are ready to use. This box is easy to stack and when installed on the side of a table it works well. Unfortunately, this box does not sit flat on the table, and it is so light that it slips and slides around on the table and is very easily knocked over. Even if a strip of gripping material is placed under the entire box, the design of the box still causes the box to be knocked over very easily, strewing the cards on the floor. The slot in the back of this box holds the alert cards; if they are not moved to the front of the box they may be crushed. The open area in the middle of the box allows dirt and debris to enter the box, soiling the cards. The cards are slightly tilted, which makes the cards easier to read than with other box designs. The box is very light.

The Trio Bidding box from Sweden is one of the most recently developed biding boxes. It is rectangular and longer than any of the other boxes described above. This is a flip box with three compartments. The small pass cards, etc., are in the front, and the suit cards are in the back of the box. The stop and alert cards lie flat in the middle. This box is easy to store and easy to open although it takes up more room than many other boxes and thus crowds the table. When the box is opened for use, it does not lie flat. When the covers of the box are opened, the box rests on the thin bottoms of the covers. This box is very light, slippery, and is easy to knock over, although it can be mounted on the side of the table. The open area in the middle of the box permits dirt and debris to enter the box to soil the cards. This box has large alert and stop cards. When opened, the front compartment has two pointed ends that stick up over the cards, making it easy to poke or hit the box with the hand, making this box vulnerable to being knocked over.

SUMMARY OF THE INVENTION

It is an object of the present invention to overcome the aforementioned deficiencies in the prior art.

It is another object of the present invention to provide a bridge bidding box which is easily opened and closed.

It is a further object of the present invention to provide a bridge bidding box in which the cards are always in place and ready to use.

It is yet another object of the present invention to provide a bridge bidding box which lies flat on a table.

It is still another object of the present invention to provide a bridge bidding box that prevents cards from falling out if the box is knocked over.

According to the present invention, a bridge bidding box is provided comprising two parts: a bottom part and a top part. When the box is opened, the bottom part is removed and placed into a cut out area of the top part. The cut out area of the top part is angled so that when the bottom part is placed into this cut out area, the cards in the bottom part are automatically angled backwards, making it easier to see and remove the bid cards form the box. This configuration allows the entire box to lie flat on the table, providing stability and proper weight distribution. The bottom of the box is provided with non-skid gripping material, which prevents the box from moving or sliding on the table. When the bottom part is placed into the top part, the top part is at such an angle and weight distribution that it is difficult to tip over the box.

DETAILED DESCRIPTION OF THE INVENTION

Figure 1:
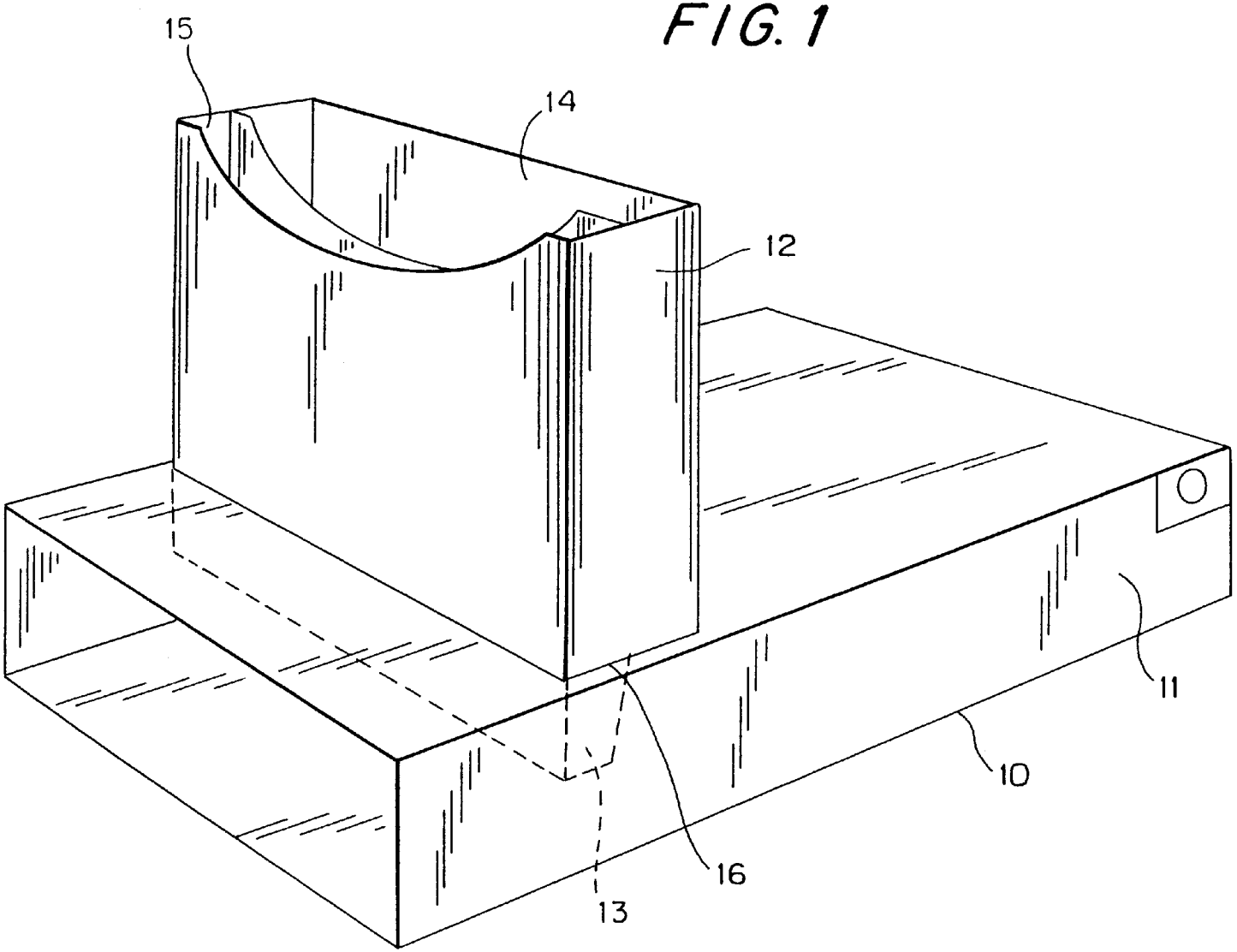
FIG. 1 shows the bridge biding box of the present invention in the open position with the bottom part placed in the cut out area of the top part.

Referring to FIG. 1, the bridge bidding box 10 is shown in the open position. The bottom part of the box 12 is placed into a cut out portion 13 in the top portion 11 of the box. This configuration maintains the bottom portion of the box in position where it is unlikely to be tipped over during play. The cards are placed into the open section 14 of the top part 12 of the box, which is provided with at least one optional divider 15 for keeping cards separated from each other. Preferably, this optional divider is oval-shaped and made of flexible plastic so that cards slide into the box easily but, once in the box, are held snugly in place. Preferably, the bottom portion has a stepped portion 16 that fits into the cut out portion 13 of the top portion.

Figure 2:
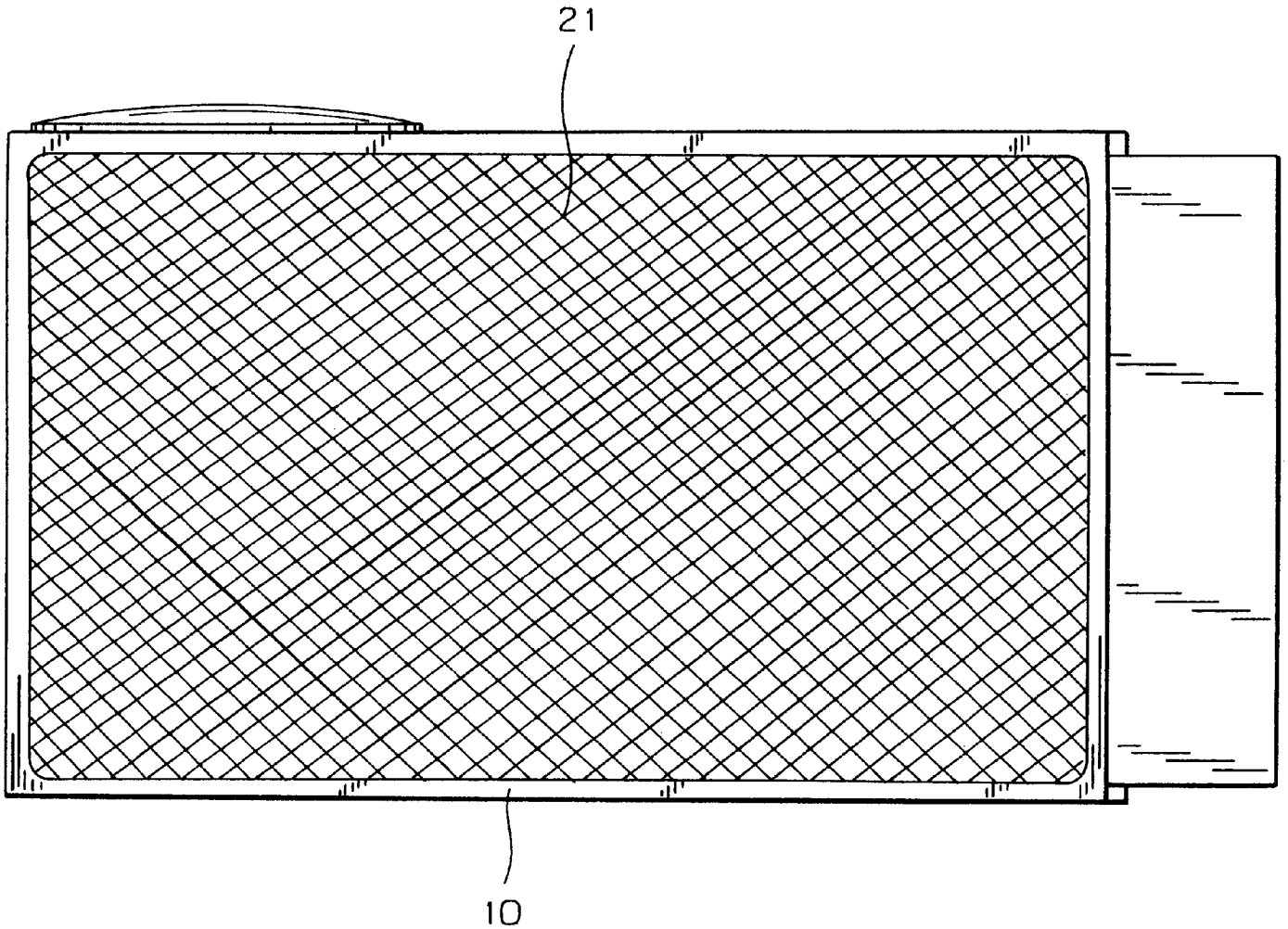
FIG. 2 shows the bottom of the bridge biding box of the present invention.

FIG. 2 shows the bottom of the bridge bidding box 10 wherein a non-slip surface 21 is provided over the bottom of the box. This non-slip material allows the box to tip over onto its side, rather than sliding off the table, in the event that the box is knocked over by waving hands.

Figure 3A:
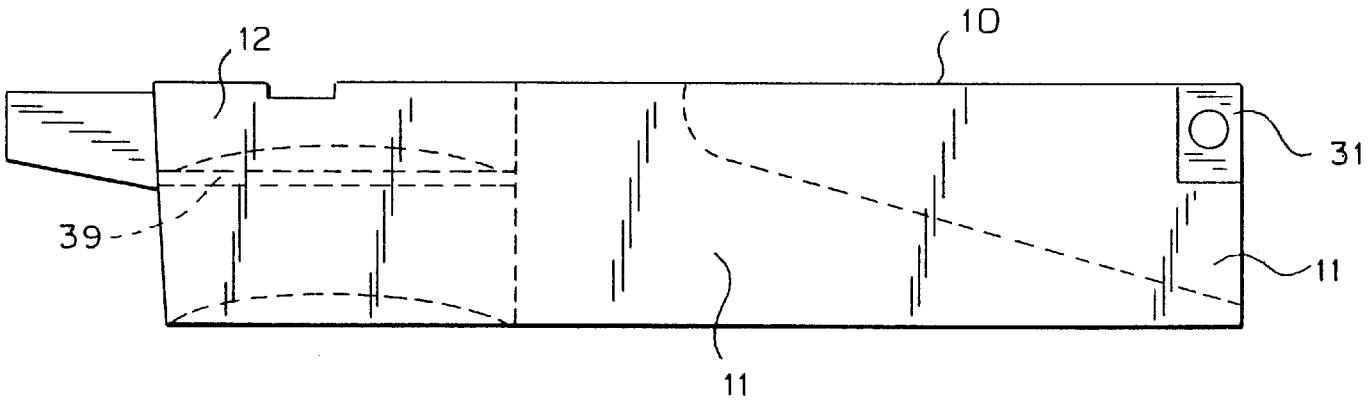
FIGS. 3A and 3B show a side view of the bridge biding box of the present invention in the closed position.

FIG. 3A shows one side view of the box in a closed position, with the bottom part 12 covering the cards 39. An optional pencil sharpener 31 is located on one side of the top part 11 of the box.

Figure 3B:
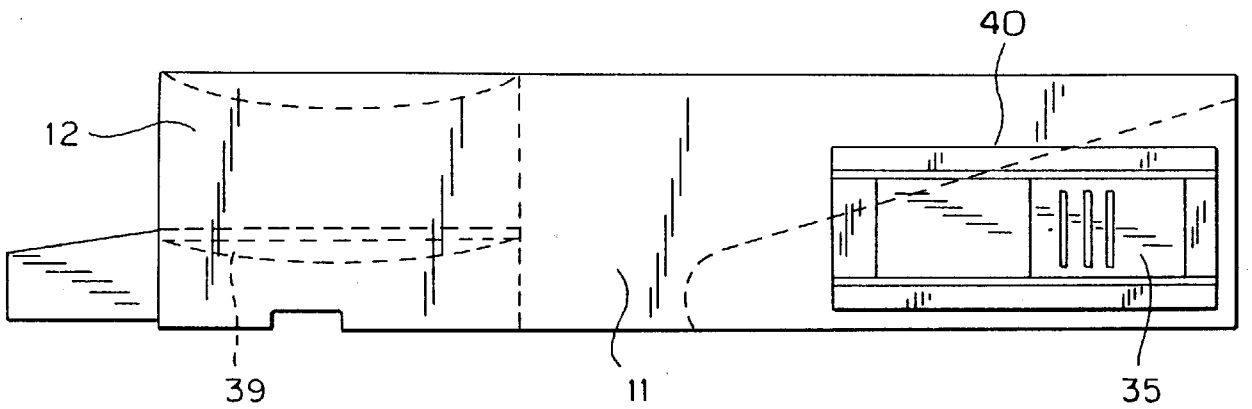

FIG. 3B shows the other side view of the box in a closed position, with the bottom part 12 enclosing the cards 39. An opening 40 is provided on the side of the box opposite the pencil sharpener 31 for discharge of sharpening waste. This opening is closed by a sliding door 35 to retain the waste in place until it is discarded.

Figure 4:
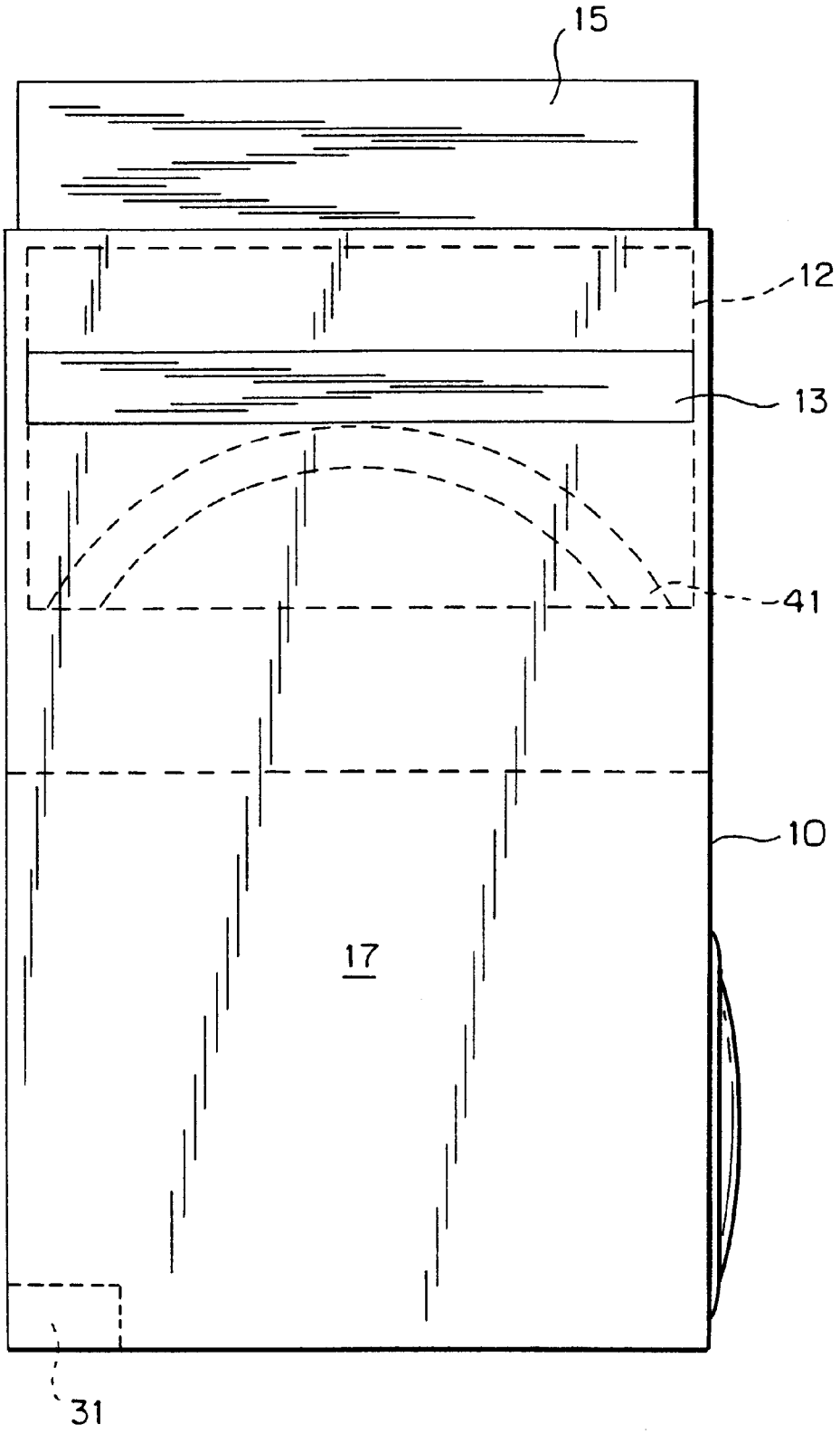
FIG. 4 shows the top of the bridge biding box of the present invention in the closed position.

FIG. 4 shows a top plan view of the box 10 in the closed position showing the opening 13 in the top part of the box into which the bottom part of the box fits when the box is opened. The opening, or cut out portion 14, of the top section 12 has built out interior sides and a flex band 41 that prevents the cards from falling out.

The top part 11 has a smooth angled wall 17 that allows the case to close easily and keeps the cards in place when closed. When closed, the bidding box 10 has no openings to allow dirt or dust to enter the box. This box is easily stackable, and takes up less space than conventionally available boxes. This box can be table mounted with ease for left or right handed players.

There are many advantages to the bidding box of the present invention. This box has a low center of gravity, making it less likely than conventional bidding boxes to tip over during play. The box lies flat on the table when used in play, and lies flat for stacking and storage. The bottom of the box has a non-skid surface, which prevents it from sliding or flying off the table. In fact, if a hand knocks the box over, the box turns onto its side because of its low center of gravity and the non-skid surface on the bottom.

The bidding box is easy to take apart and put back together. There is no place where dust or debris can enter the box. An optional built in pencil sharpener eliminates the need for additional equipment during play. The bottom part of the box is angled so that when placed in position with the cards, it is tilted, making it easy to read and to remove the cards from the box. The top inside of the box holds the cards in place when stored, preserving the cards.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus, the expressions "means to . . . " and "means for . . . ", or any method step language, as may be found in the specification above and/or in the claims below, followed by a functional statement, are intended to define and cover whatever structural, physical, chemical, or electrical element or structure, or whatever method step, which may now or in the future exist which carries out the recited functions, whether or not precisely equivalent to the embodiment or embodiments disclosed in the specification above, i.e., other means or steps for carrying out the same function can be used; and it is intended that such expressions be given their broadest interpretation.

What is claimed is:

1. A bridge bidding box comprising a top part and a bottom part;

a) the top part includes a cut out portion which holds the bottom part in upright position;

b) the bottom part is angled such that when the bottom part is placed into the cut out portion of the top part the bottom part leans backwards.

2. The bridge bidding box according to claim 1 wherein the top part includes a pencil sharpener.

3. The bridge bidding box according to claim 2 wherein the pencil sharpener is located on one side of the top part and an opening is located opposite the pencil sharpener on the opposite side of the top part.

4. The bridge bidding box according to claim 1 wherein the bottom of said box is provided with non-skid gripping material.

5. The bridge bidding box according to claim 1 wherein card storage is provided on the inside of the top part of the box.

6. The bridge bidding box according to claim 5 wherein a divider is provided in the card storage area.

7. The bridge bidding box according to claim 6 wherein the divider is flexible and is oval in shape.

8. The bridge bidding box according to claim 1 wherein the top part includes a smooth angled wall.

9. The bridge bidding box according to claim 1 wherein the cut out portion of the top part has built out interior sides and a flex part.

* * * * *